US011207907B2

(12) United States Patent
Pirmoradi et al.

(10) Patent No.: US 11,207,907 B2
(45) Date of Patent: Dec. 28, 2021

(54) EXPANDING THE COLOR GAMUT OF THERMOCHROMIC MATERIALS

(71) Applicant: Palo Alto Research Center Incorporated, Palo Alto, CA (US)

(72) Inventors: Fatemeh Nazly Pirmoradi, Menlo Park, CA (US); Christopher L. Chua, San Jose, CA (US); Kyle Arakaki, Mountain View, CA (US); Jacob N. Chamoun, San Mateo, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 17/087,368

(22) Filed: Nov. 2, 2020

(65) Prior Publication Data

US 2021/0053377 A1 Feb. 25, 2021

Related U.S. Application Data

(62) Division of application No. 16/211,992, filed on Dec. 6, 2018, now Pat. No. 10,875,343.

(51) Int. Cl.

| | |
|---|---|
| ***B41J 2/32*** | (2006.01) |
| ***B41M 7/00*** | (2006.01) |
| ***B41M 5/28*** | (2006.01) |
| ***B41M 5/34*** | (2006.01) |

(52) U.S. Cl.

CPC ..... *B41M 5/282* (2013.01); *B41J 2/32* (2013.01); *B41M 5/34* (2013.01); *B41M 7/0081* (2013.01)

(58) Field of Classification Search

CPC ..... B41M 5/282; B41M 5/34; B41M 7/0081; B41J 2/32; B41J 2/525; B41J 35/16; B41J 35/18; B41J 2002/0052; B41F 16/00; B41F 16/0006

See application file for complete search history.

(56) References Cited

U.S. PATENT DOCUMENTS

| | | | | |
|---|---|---|---|---|
| 7,319,472 | B2 | 1/2008 | Inoue | |
| 8,842,145 | B2 | 9/2014 | Cridland et al. | |
| 9,475,307 | B2 | 10/2016 | Cridland | |
| 2007/0092828 | A1* | 4/2007 | Gore | G03F 7/105 430/270.1 |
| 2008/0318154 | A1 | 12/2008 | Wyres | |
| 2009/0085996 | A1* | 4/2009 | Kasai | B41M 5/0011 347/100 |
| 2014/0054827 | A1 | 2/2014 | Mullane et al. | |
| 2018/0147874 | A1* | 5/2018 | Steenackers | B41M 5/345 |

FOREIGN PATENT DOCUMENTS

| | | |
|---|---|---|
| JP | H0531931 | 2/1993 |

* cited by examiner

*Primary Examiner* — Kristal Feggins

(74) *Attorney, Agent, or Firm* — Mueting Raasch Group

(57) ABSTRACT

Formation of a multi-colored image in thermochromic material involves controlling operation of first, second, and third heat sources. The first heat source heats pixels of the thermochromic material to activate the pixels. The second and third heat sources are selectively controlled to heat different sets of pixels using neither, one, or both of the second and third heat sources.

21 Claims, 16 Drawing Sheets

EXPANDING THE COLOR GAMUT OF THERMOCHROMIC MATERIALS

RELATED APPLICATIONS

This application is a divisional of U.S. patent application Ser. No. 16/211,992, filed Dec. 6, 2018, which is incorporated herein by reference in its entirety.

BACKGROUND

Thermochromic materials change color in response to exposure to temperature and light. Thermochromic inks can be applied to relatively larger areas on a substrate by a number of printing or coating processes such as lithography, flexography, gravure, screen printing, spreading with film applicators. After coating or printing the larger areas with the thermochromic material, the areas are exposed to heat and light to produce a color change in precisely controlled regions.

BRIEF SUMMARY

Some embodiments are directed to a method of forming a multi-colored image on a substrate that includes a thermochromic material capable of producing at least two different colors. The method includes controlling the operation of first, second and third heat sources. The first heat source is controlled to heat pixels of the thermochromic material to one or more first temperatures sufficient to activate the pixels. After heating the pixels to the one more first temperatures, the first UV radiation source floods an area that includes the pixels with a first UV radiation exposure. After flooding the area with the first UV radiation exposure, one or both of the second and the third heat sources are selectively controlled to heat the pixels to one or more temperatures sufficient to color shift the pixels. Selectively controlling one or both of the second and third heat sources comprises one of: 1) not heating the pixels with either of the second and third heating sources; 2) heating the pixels with the third heat source and not heating the pixels with the second heat source; 3) heating the pixels with second heat source and not heating the pixels with the third heat source; or 4) sequentially heating the pixels with the second heat source and the third heat source. The second UV radiation source floods the area that includes the pixels with a second UV radiation exposure before each time the pixels are heated to by the third heat source.

According to some embodiments, a method of forming a multi-colored image on a substrate that includes a thermochromic material includes a) heating pixels of the thermochromic material that correspond to the image to a first temperature sufficient to activate the pixels of the thermochromic material for color shift; 2) flooding an area that includes the pixels with a first UV radiation exposure sufficient to partially polymerize the thermochromic material; 3) heating the pixels to one or more second temperatures after flooding the area with the first UV radiation dosage; and 4) iteratively performing one or more additional cycles until desired color shifts of the pixels are obtained. Each cycle comprises flooding the area that includes the pixels with an additional UV radiation exposure followed by heating the pixels to one or more additional temperatures.

Some embodiments describe a system for forming a multi-colored image on a substrate that includes a thermochromic material capable of producing at least two different colors. The system includes first, second, and third, heat sources and first and second UV radiation sources. The system includes a controller configured to control the heat sources. The controller is configured to control the operation of the first heat source to heat first, second, third, and fourth sets of pixels of the thermochromic material to one of more first temperatures sufficient to activate the thermochromic material of the pixels. The controller is configured to selectively control operation of the second and third heat sources to heat the pixels in the first, second, third, and fourth sets of pixels to one or more temperatures sufficient to color shift the pixels. The controller controls the operation of the second and third heat sources such that 1) the first and second sets of pixels are not exposed to heat producing energy produced by the second heat source; 2) the third set and fourth sets of pixels are exposed to heat producing energy produced by the second heat source; 3) the first and third sets of pixels are not exposed to heat producing energy produced by the third heat source; 4) the second and fourth sets of pixels are exposed to heat producing energy produced by the third heat source. A first UV source is configured to expose the first, second, third, and fourth sets of pixels to a first UV radiation exposure after or during a time that the first, second, third, and fourth sets of pixels are exposed to the first heat producing energy. A second UV source is configured to expose the first, second, third, and fourth sets of pixels to a second UV radiation exposure after or during a time that the second and fourth sets of pixels are exposed to the second heat producing energy.

Some embodiments involve an article that includes a layer of thermochromic material disposed in or on a substrate. The color of the thermochromic material falls within at least one of: 1) a region of a standard CIE color chart above about 0.25 and below about 0.4 on the y-axis and above 0.2 and below about 0.5 on the x-axis; and 2) a region of a standard CIE color chart bounded by a line expressed by the equation $y>0.47x+0.08$ and a line expressed by the equation $y>0.47x+0.2$.

BRIEF DESCRIPTION OF DRAWINGS

The figures are not necessarily to scale. Like numbers used in the figures refer to like components. However, it will be understood that the use of a number to refer to a component in a given figure is not intended to limit the component in another figure labeled with the same number.

DETAILED DESCRIPTION OF ILLUSTRATIVE EMBODIMENTS

Image formation as discussed herein involves the use of a thermochromic material that changes color when exposed to heat and light allowing for digital color image formation at high speeds and large working distances. Current standard thermochromic material thermal processing steps generate colors substantially limited to blues and reds and colors lying on the line 310 connecting blue 320 and red 330 as depicted in the standard CIE color chart of FIG. 3. The color gamut achieved by standard processing of thermochromic materials has a limited range of colors.

According to some approaches described herein, the history of the thermochromic material processing temperatures and UV radiation exposures can be utilized to control the final color of the thermochromic material. Embodiments herein involve systems and methods for image formation that provide an expanded color gamut for thermochromic materials.

According to some aspects, second and third heating steps after the first activation heating step may be selectively performed to achieve different final colors.

According to some aspects, the thermochromic material is exposed to one or more additional cycles comprising a UV radiation exposure step followed by a heating step after initial activation and color shifting of the thermochromic material. The additional cycles may be iteratively performed until a desired color is achieved.

Figure 1:
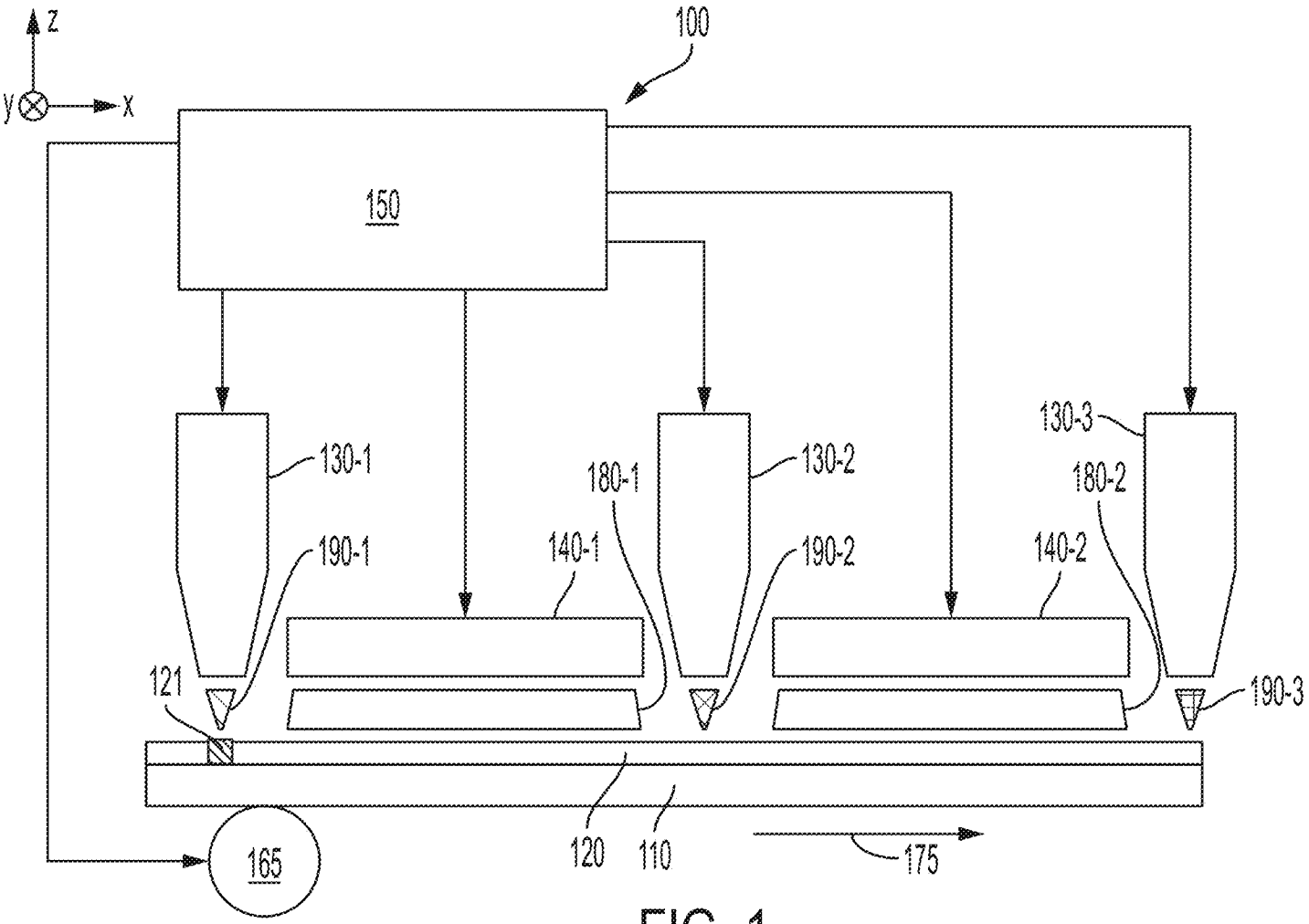
FIG. 1 illustrates a side view of a system for forming an image in pixels of a thermochromic material disposed on a substrate in accordance with some embodiments.

A system 100 for forming a multi-colored image in a layer 120 comprising thermochromic material disposed on a substrate 110 is shown in the block diagram of FIG. 1. The layer 120 is shown extending along the x-axis in the side view of FIG. 1, however, it will be appreciated that the layer 120 also extends along the y-axis. The thermochromic layer 120 may be substantially continuous or discontinuous and may be patterned into segments of thermochromic material.

The layer 120 may be deposited by any suitable printing process, e.g., ink jet printing, screen printing, flexographic printing, etc. The thermochromic material can be or can include diacetylene and/or or another thermochromic material capable of producing at least two colors, e.g., red and blue. In some embodiments, other additives that control and/or assist in heat absorption and/or heat retention may also be included in the layer 120. For example, in embodiments wherein the thermochromic material is heated by radiation, infrared (IR) and/or near infrared (NIR) radiation absorbers may be included in the layer to adjust the response of the thermochromic material to the radiation.

Prior to processing by heating and UV radiation exposure, the thermochromic material 120 may be colorless. Prior to processing, the thermochromic material 120 can be substantially clear such that the substrate 110 is visible through the thermochromic material 120. During processing individually selected pixels 121 of the thermochromic material 120 attain different colors according to the image being formed. Pixels that are not selected for image formation are not activated for color change and may remain substantially clear such that the substrate 110 is visible through the thermochromic material 120 of the non-selected pixels.

In the particular embodiment illustrated in FIG. 1, the system 100 includes at least first, second, and third imaging heat sources 130-1, 130-2, 130-3, first and second UV radiation flood sources 140-1, 140-2 and a controller 150. The controller 150 can control the intensity and spatial pattern of the heat producing energy 190-1, 190-2, 190-3 generated by the imaging heat sources 130-1, 130-2, 130-3 and can control the intensity of the radiation dosage 180-1, 180-2 generated by the UV radiation flood sources 140-1, 140-2. In some embodiments, one or more of the heat sources 130-1, 130-2, 130-3 and/or one or more of the UV radiation sources may comprise multiple heat elements or multiple UV radiation elements. Controlling the intensity of the heat producing energy and/or the UV radiation dosage may comprise turning a subset of the heat elements or UV radiation elements on or off.

Pixels of the thermochromic material 120 are individually addressable by the imaging heat sources 130-1, 130-2, 130-3. The controller 150 maps the image pixels to pixels 121 of the thermochromic material 120 and controls the operation of the imaging heat sources 130-1, 130-2, 130-3 to heat individually selected pixels that correspond to image pixels.

The system 100 includes a movement mechanism component 165 configured to move the substrate 110 so that thermochromic material 120 moves from station to station during processing. For example, FIG. 1 shows the state of the system 100 at time t1 during which one or more pixels 121 being heated by the heat producing energy 190-1 generated by heat source 130-1. Under control of the controller 150, the movement mechanism component 165 moves the substrate 110 along the processing direction indicated by arrow 175 such that the pixels 121 sequentially come into position to be processed by each of the first imaging heat source 130-1, the first UV radiation source 140-1, the second imaging heat source 130-2, the second UV radiation source 140-2, and the third imaging heat source 130-3.

In some embodiments, the movement mechanism includes additional components that provide for translational and/or rotational movement of some or all of the first, second, and third heat sources 130-1, 130-2, 130-3 and/or UV radiation sources 140-1, 140-1. In some embodiments, the movement mechanism includes additional components that provide for changing the direction of the heat producing energy generated by the first, second, and third heat sources 130-1, 130-2, 130-3 and/or the direction of the radiation generated by the UV radiation sources 140-1, 140-1 to be changed. For example, the additional components of the movement mechanism may change the direction of the heat producing energy generated by the heat sources 130-1, 130-2, 130-3 and/or UV radiation generated by the UV radiation sources 140-1, 140-2 by deflecting or reflecting the heat producing energy and/or UV radiation without translationally or rotationally moving the heat sources 130-1, 130-2, 130-3 and UV radiation sources 140-1, 140-2 themselves.

Figure 2:
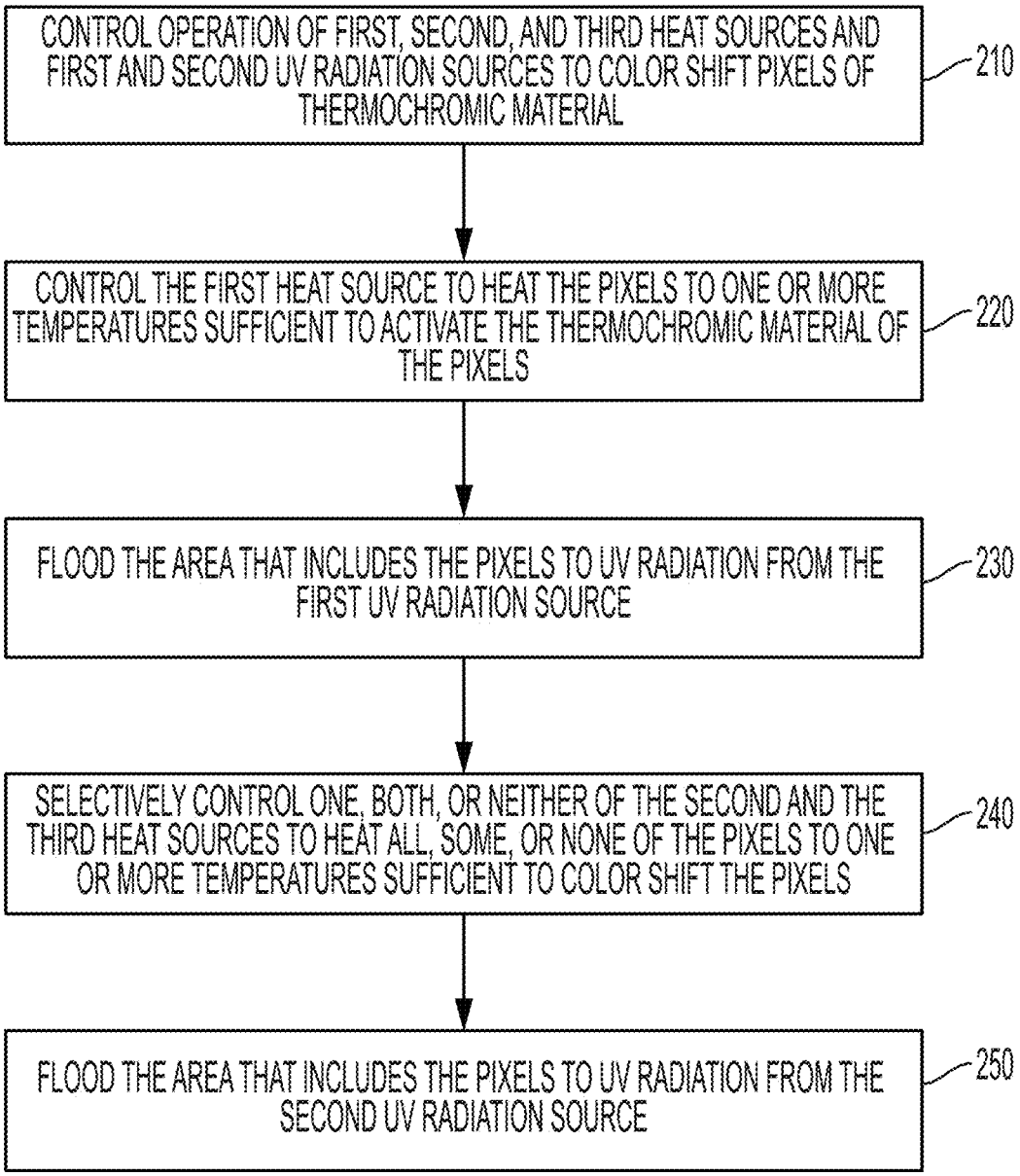
FIG. 2 is a flow diagram of a method of forming a multi-colored image on a substrate that includes a thermochromic material that can be implemented by system of FIG. 1.

FIG. 2 is a flow diagram of a method of forming a multi-colored image on a substrate that includes a thermochromic material that can be implemented by system 100 of FIG. 1. The process of image formation according to some embodiment is described below with reference to both FIG. 1 and FIG. 2.

As depicted in FIG. 1, at time t1, the controller 150 operates 210 the first imaging heat source 130-1 to generate a heat producing energy 190-1 that heats one or more individually selected pixels 121 of the thermochromic material 120 to one or more first temperatures sufficient to activate the pixels 121 for color shift. In some embodiments, activation of the pixels 121 occurs when heating forms liquid crystals in the thermochromic material 120.

To produce a multi-hued image, the pixels 121 can be heated to multiple different first temperatures wherein each first temperature corresponds to different degrees of activation. The different degrees of activation lead to different darkness levels in the final colors formed. For example, pixels not heated or heated below a threshold activation temperature would remain unchanged after the entire color processing sequence. Pixels heated to temperatures slightly above the threshold activation temperature in the first heating step would achieve a lighter saturation after the complete color processing sequence. Pixels heated to temperatures above a full activation temperature in the first heating step would attain a darker color saturation after the complete color processing sequence. In some embodiments, the threshold activation temperature is about 80° C. and the full activation temperature is about 110° C. These values of threshold activation temperature and full activation temperature can be adjusted depending on the constituent molecules and coating thickness used in the thermochromic material.

The controller 150 controls the movement mechanism component 165 to move the substrate 110 having the thermochromic layer 120 disposed thereon along the direction of arrow 175 until the pixels 121 are position to be processed by the first UV radiation source 140-1. The first UV radiation source 140-1 floods 220 an area that includes the 121 pixels with a first UV radiation dosage 180-1 sufficient to partially polymerize the liquid crystals in thermochromic material 120. Exposing the activated pixels 121 to the first UV radiation dosage 180-1 changes the color of the pixels 121. For example, in some embodiments exposing the activated pixels to the first UV radiation dosage 180-1 changes the color of the pixels 121 to blue.

The controller 150 controls the movement mechanism component 165 to move the pixels 121 into position to be heated 240 by the second heat source 130-2 and/or the third heat source 130-3 and to be exposed to UV radiation by the second UV radiation source. Depending on the desired color, the controller may control the second and third heat sources such that none, some, or all of the pixels are not heated by either of the second and third heat sources; none, some, or all of the pixels are heated by the third heat source and are not heated by the second heat source; none, some, or all of the pixels are heated by the second heat source and are not heated by the third heat source; and none, some, or all of the pixels are heated by both the second and third heat source. After heating by the second heat source, the second UV radiation source 140-2 floods 250 the pixels 121 with a second UV radiation dosage 180-2. In some embodiments, heating by the third heat source may occur during the same time that the pixels are being flooded with UV radiation by the second UV radiation source 140-2.

In some embodiments, the pixels 121 move continuously through all the heat sources 130-1, 130-2, and 130-3 and UV sources 140-1 and 140-2, and the heating and UV exposures occur as the pixels 121 move across the sources. In some embodiments, UV sources 140-1 and 140-2 remain constantly on and the UV exposure dosage from each of the UV sources is determined by a combination of UV intensity of each source and substrate speed as the pixels move past the UV source.

Heating the selected pixels 121 by the second and/or third heat sources 130-2, 130-3 causes color shifts in the appearance of the thermochromic material of the pixels 121. Each of the second and/or third heat sources 130-2, 130-3 may heat different sets pixels of the selected pixels 121 to different temperatures according to the desired color of the sets of pixels in the image. For example, the controller 150 may operate the second heat source 130-2 to generate a second heat producing energy 190-2 that heats none, some, or all of the pixels 121 selected for image formation. The pixels that are heated by the second heat producing energy 190-2 may be heated to one or more temperatures depending on the desired color shift of the pixels. The controller 150 may operate the third heat source 130-3 to generate a third heat producing energy 190-3 that heats none, some, or all of the selected pixels 121. The pixels that are heated by the third heat producing energy 190-3 may be heated to one or more third temperatures depending on the desired color shift of the pixels. Heating a pixel to a higher temperature causes the thermochromic material of the pixel to shift to a different color when compared to the color shift caused by heating to a lower temperature.

TABLE 1

| | Color | Heat Source 1 | UV Source 1 | Heat Source 2 | UV Source 2 | Heat Source 3 |
|---|---|---|---|---|---|---|
| Set 1 | Blue | ON | ON | OFF | ON | OFF |
| Set 2 | Red | ON | ON | OFF | ON | ON |
| Set 3 | Purple | ON | ON | ON | ON | OFF |
| Set 4 | Purple → Red | ON | ON | ON | ON | ON |

As illustrated by the example of Table 1, different sets of the individually selected pixels 121 may be heated by the second and/or third heat sources. In some embodiments at least one of the sets of pixels may include no pixels (null set).

With reference to Table 1, all pixels selected for image formation in sets 1-4 are heated by the first heat source 130-1 for activation as indicated by column 3 of Table 1. Different pixels in sets 1-4 may see different intensities from heat source 130-1 depending on their desired level of saturation.

All pixels in sets 1-4 are exposed to the first UV radiation dosage 180-1 by the UV radiation source 140-1 as indicated by of Table 1. Activation heating followed by exposure to the first UV radiation dosage 180-1 changes the color of a first set of pixels to blue (area 320 of the CIE color chart shown in FIG. 3).

The heat source 130-2 is controlled so set 1 pixels are not exposed to heating by heat producing energy 190-2. Set 2 pixels are not exposed. Set 3 pixels are exposed. Set 4 pixels are exposed. At this stage of the process, sets 1 and 2 pixels which are not exposed to heating remain blue (area 320 of CIE color chart shown in FIG. 3), while sets 3 and 4 pixels that are exposed to heating turn red (e.g., areas 325 and 330 of CIE color chart shown in FIG. 3).

All pixels are exposed to UV radiation dosage 180-2 from UV source 140-2. At this stage, sets 1 and 2 pixels remain blue (no change), while sets 3 and 4 pixels shift from red to purple, e.g., a purple color falling within area 345 of CIE color chart shown in FIG. 3.

The heat source 130-3 is controlled so set 1 pixels are not exposed to heat producing energy 190-3, so set 1 pixels remain blue. Set 2 pixels are exposed to heat producing energy 190-3, which turns them from blue to red. Set 3 pixels are not exposed to heat producing energy 190-3, so set 3 pixels remain purple. Set 4 pixels are exposed to heat producing energy 190-3, changing their color from purple toward red (e.g., a color falling within area 345 of CIE color chart shown in FIG. 3).

The end result is a composite image comprising of blue (set 1), red (set 2), purple (set 3), and brownish (set 4) pixels. The color appearance of each region in the image is determined by the relative placement and fill factor of blues, reds, and purple.

Figure 3:
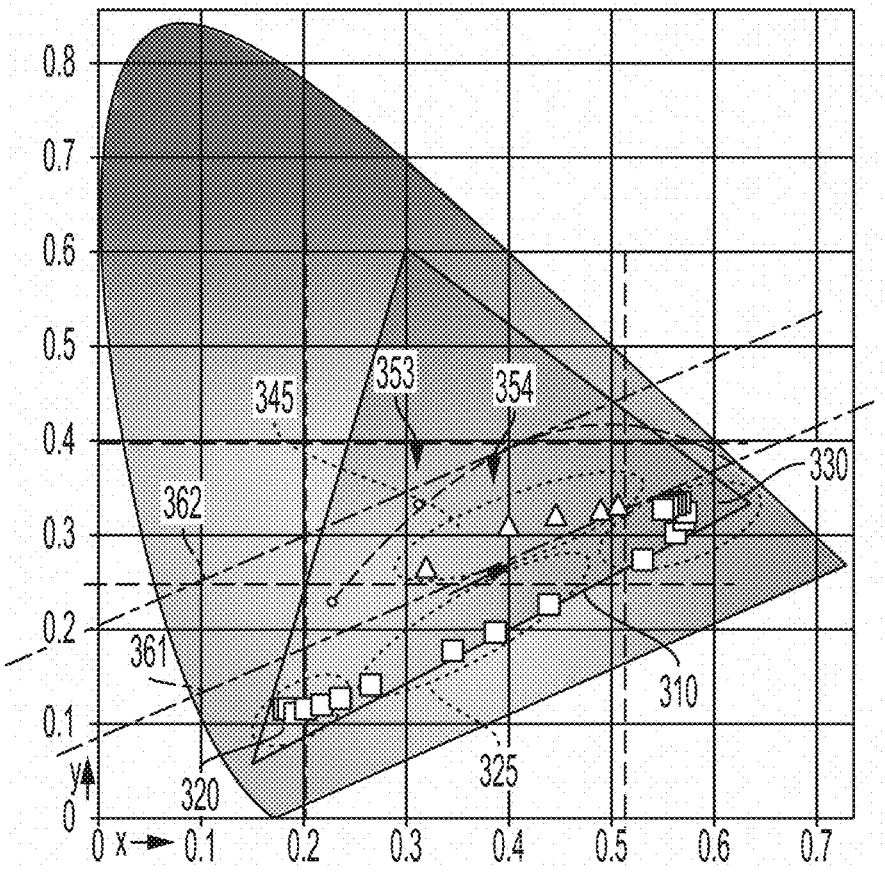
FIG. 3 is standard CIE color chart illustrating new colors obtainable using the approaches discussed herein.

In one embodiment, the new colors fall in a region 353 above about 0.25 and below about 0.4 on the y-axis of the standard CIE color chart and above 0.2 and below about 0.5 on the x-axis of the standard CIE color chart shown in FIG. 3. For example, the new colors can be characterized in terms of the standard CIE color chart shown in FIG. 3 as a region 354 bounded by line 361 expressed by the equation y=0.47x+0.08 and line 362 expressed by the equation y=0.47x+0.2. These new colors can be combined with previously achieved primary colors to reach color appearances represented by the bounded regions 353 in FIG. 3.

Figure 4:
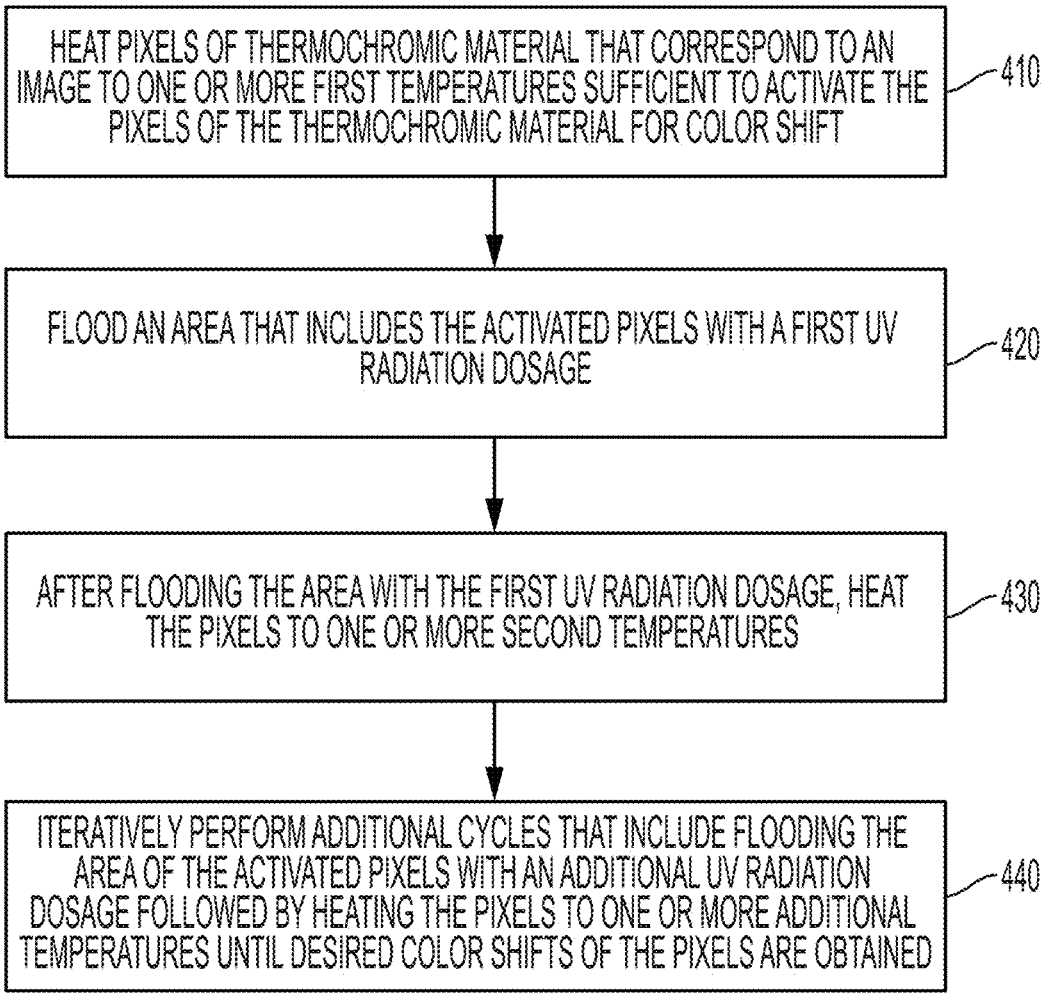
FIG. 4 is a flow diagram of a method of forming a multi-colored image on a substrate that includes a thermochromic material including performing iterative cycles in accordance with some embodiments.

In some embodiments, after the first activation heating step, the first UV radiation exposure, and the second heating step, one or more cycles comprising an additional UV radiation exposure followed by an additional heating step may be performed until a desired color is achieved. FIG. 4 is a flow diagram of a method of forming a multi-colored image in thermochromic material on a substrate that involves multiple iterations of the cycles comprising the additional UV radiation exposure and heating steps.

According to the method of FIG. 4, one or more individually selected pixels of the thermochromic material that correspond to pixels of the image are heated 410 to one or more first temperatures that are sufficient to activate the pixels of the thermochromic material for color shift as previously discussed. An area that includes the pixels is flooded 420 with a first UV radiation exposure sufficient to partially polymerize the liquid crystals in thermochromic material. The pixels are heated 440 to one or more second temperatures that initially color shift the thermochromic material of the pixels. The process involves iteratively performing 440 one or more cycles, each cycle comprising flooding the area that includes the individually selected pixels with an additional UV radiation exposure followed by heating the pixels to one or more additional temperatures until a desired color shift of the pixels is achieved.

The first UV radiation exposure changes the color of the pixels to a first color, e.g., blue. Subsequently heating the thermochromic material to the second temperatures color shifts the thermochromic material to a second color, e.g., red. Additional cycles of UV radiation and heating shifts the color of the thermochromic material to additional colors that are between the first and second colors on the standard CIE color chart shown in FIG. 3. The additional colors obtained by additional cycles of UV radiation exposure and heating include new colors that are not achievable using the standard process that does not include the iterative cycling. The new colors may fall in a region 353 above about 0.25 and below about 0.4 on the y-axis of the standard CIE color chart and above 0.2 and below about 0.5 on the x-axis of the standard CIE color chart shown in FIG. 3. For example, the new colors can be characterized in terms of the standard CIE color chart shown in FIG. 3 as a region 354 bounded by line 361 expressed by the equation y=0.47x+0.08 and line 362 expressed by the equation y=0.47x+0.2

Figure 5:
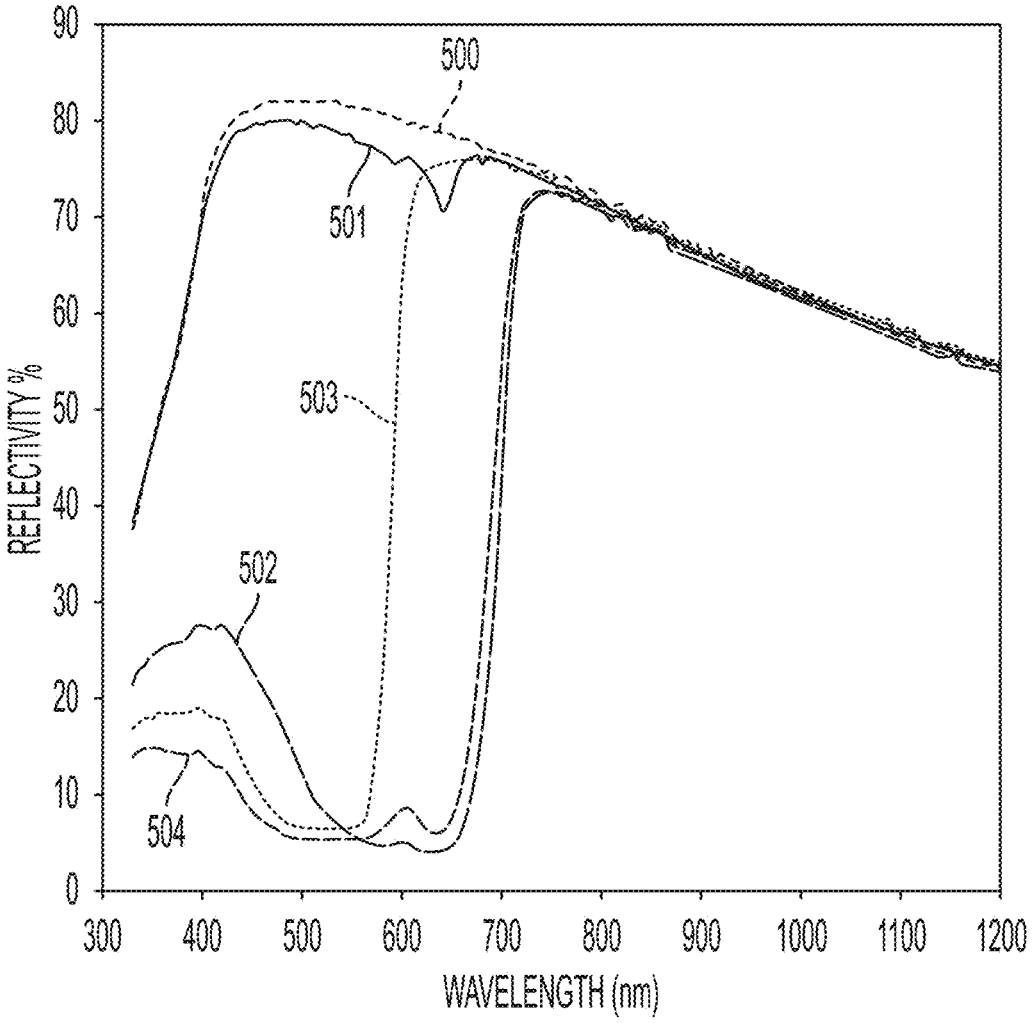
FIG. 5 includes graphs of reflectivity spectrums of thermochromic material in various stages of processing in accordance with some embodiments.

The graphs of FIG. 5 illustrate the color shifts of a sample of thermochromic material according to a particular implementation. FIG. 5 depicts the reflectivity spectrum of the unprocessed thermochromic material (graph 500); the reflectivity spectrum of the thermochromic material after the activation heating step (graph 501); the reflectivity spectrum of the thermochromic material after the first UV radiation exposure (graph 502); the reflectivity spectrum of the thermochromic material after the thermochromic material is heated to the second temperature which initially shifts the color of the thermochromic material (graph 503); and the reflectivity spectrum of the thermochromic material after the first cycle comprising an additional UV radiation exposure (graph 504).

As indicated in graph 502, exposure of the thermochromic material to the first UV radiation dosage changes the color of the thermochromic material toward the blue end of the spectrum. Heating the thermochromic material to the second temperature after the first UV radiation exposure shifts the color of the thermochromic material toward the red end of the spectrum as show in graph 503. As indicated in graph 504, the additional UV radiation exposure shifts the color of the thermochromic material back toward the spectrum present after the first UV radiation exposure (graph 502), but with a depressed blue component and a peak at 605 nm.

Figure 6:
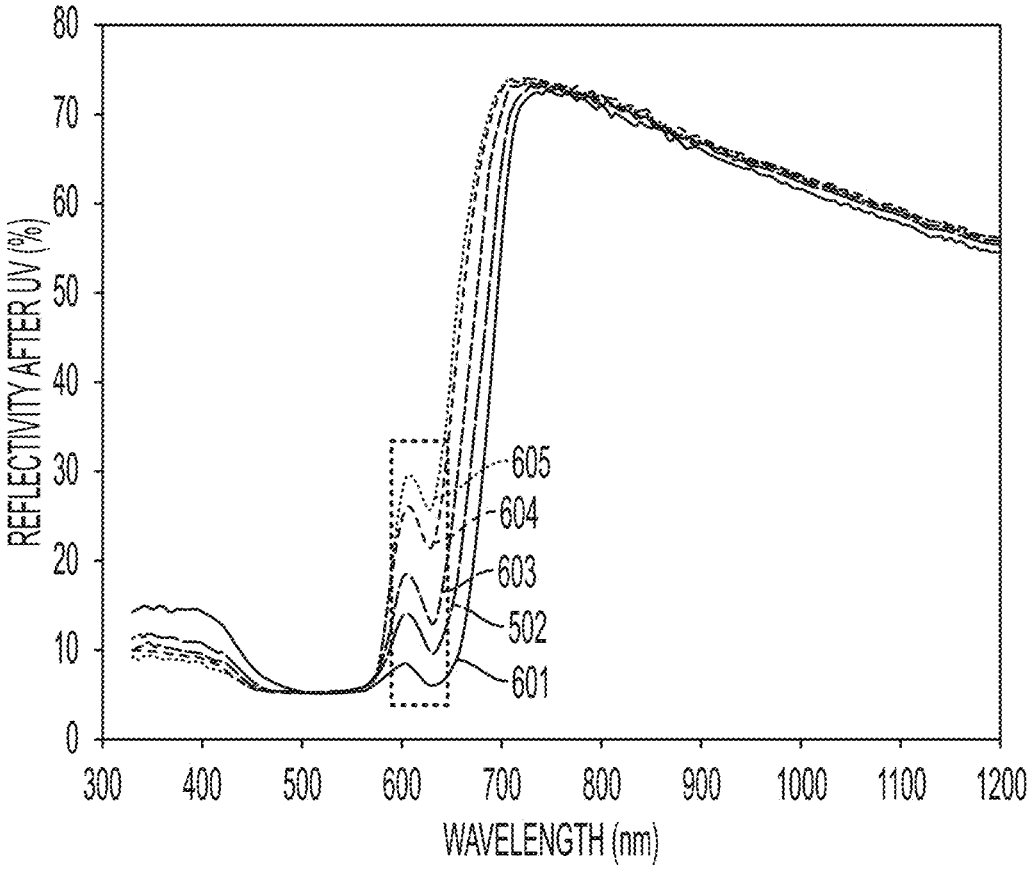
FIG. 6 provides graphs of reflectivity spectrums of thermochromic material after multiple iterative processing cycles are performed according to some embodiments.

With additional UV radiation exposures, a range of colors can be achieved. Multiple UV radiation exposures and heating steps changed the color of the thermochromic material in the example discussed above from purple to velvet to reddish brown as illustrated by the graphs of FIG. 6. FIG. 6 shows the reflectivity spectrum of the thermochromic material after one additional cycle comprising a UV radiation exposure and a heating step (graph 601); after two additional cycles (graph 602); after three additional cycles (graph 603); after four additional cycles (graph 604); and after five additional cycles (graph 605). With each additional cycle comprising a UV radiation exposure and a heating step, the reflectivity spectrum of the thermochromic material shifts increasingly from the spectrum of the thermochromic material after the second heating step toward the spectrum of the thermochromic material after the first UV radiation exposure.

Figure 7A:
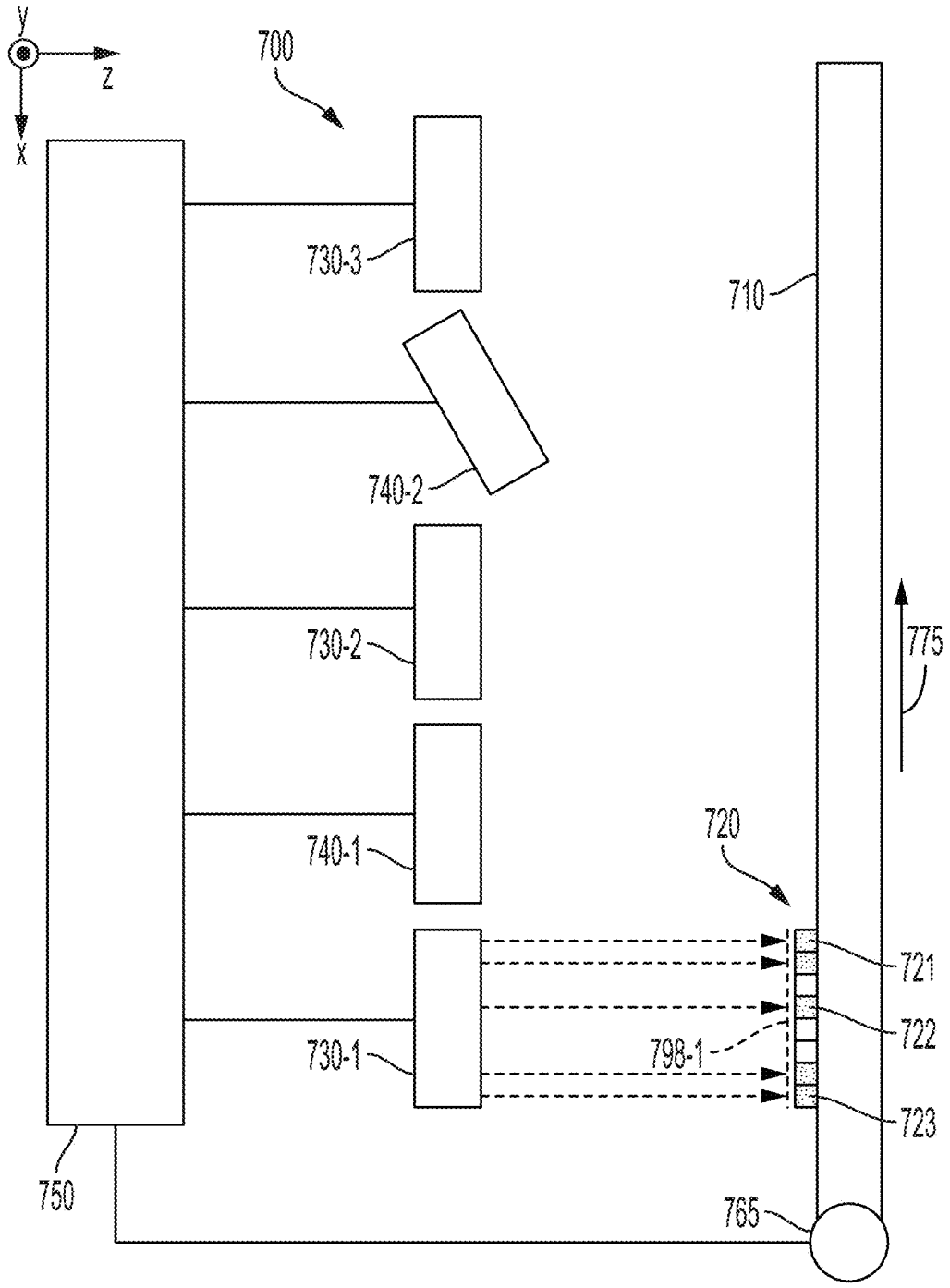
FIGS. 7A through 7G are block diagrams that illustrate operation of a system in accordance with some embodiments.

FIG. 7A is a side view block diagram of a system 700 for forming a multi-colored image in layer of thermochromic material 720 disposed in or on a substrate 710 in accordance with some embodiments.

The system 700 includes a first imaging heat source 730-1, a first UV radiation source 740-1, a second imaging heat source 730-2, a second UV radiation source 740-2, a third imaging heat source 730-3. A controller 750 can be coupled to control the operation of one more of the imaging heat sources 730-1, 730-2, 730-3, one or more of the UV radiation sources 740-1, 740-2, and/or to control the movement mechanism component 765 that moves the substrate 710. Pixels 721, 722, 723 of the thermochromic layer 720 are individually addressable by a heat source 730. The first, second, and/or third heat sources 730-1, 730-2, 730-3 may have a resolution such that 300 pixels per inch (ppi) or 600 ppi, or even 1200 ppi individually addressable. The chosen designed resolution depends on tradeoffs between cost and application needs.

Each heat source 730-1, 730-2, 730-3 is capable of generating a heat producing energy 790-1, 790-2, 790-3 that heats individually selected pixels 721, 722 of the thermochromic material. For example, the heat source 730-1, 730-2, 730-3 may be configured to heat individually selected pixels 721, 722 while not heating other pixels 723 of the thermochromic material. Each imaging heat source 730-1, 730-2, 730-3 may be configured to produce an image plane 798-1, 798-2, 798-3 of spatially patterned heat producing energy 790-1, 790-2, 790-3 wherein the intensity of the heat producing energy 790-1, 790-2, 790-3 spatially varies across the image plane. Each heat source 730-1, 730-2, 730-3 may simultaneously heat different individually selected pixels 721, 722 within the image plane 798-1, 798-2, 798-3 of the heat source 730-1, 730-2, 730-3 to different temperatures according to the spatial intensity pattern of the heat producing energy 790-1, 790-2, 790-3 to achieve different color activation levels and/or different color shifts of the individually selected pixels 121, 122. The UV radiation sources 740-1, 740-2 are configured to flood an area 725-1, 725-2 that includes the pixels 721, 722 with UV radiation.

In some embodiments, one or more of the heat sources may produce spatially varying heat producing energy that is one pixel wide in the processing direction (x-axis in FIG. 7A) and multiple pixels long in the cross process direction (y-axis in FIG. 7A). In some embodiments, as depicted in FIG. 7A through 7G, one or more of the heat sources may produce spatially varying heat producing energy that is multiple pixels wide in the processing direction (x-axis in FIG. 7A) and multiple pixels long in the cross process direction (y-axis in FIG. 7A).

FIG. 7A through 7G illustrate the operation of a system 700 for forming an image in pixels 721, 722, 723 of a thermochromic material 720 disposed on a substrate 710 in accordance with some embodiments. The system components 730-1, 730-2, 730-3, 740-2, 740-2, 750, and 765 of the system 700, the substrate 710, and the thermochromic layer 720 are all shown in side views in FIGS. 7A through 7G.

As illustrated in FIGS. 7A through 7G, a layer 720 comprising a thermochromic material is applied to a region of the substrate 710 in which the image will be formed. The layer 720 is shown extending along the x-axis in the side view of FIGS. 7A through 7G, however, it will be appreciated that the layer 720 also extends along the y-axis. The thermochromic layer 720 may be substantially continuous or discontinuous and may be patterned into segments of the thermochromic material.

As previously discussed, layer 720 may be deposited on the substrate 710 by any suitable printing process, e.g., ink jet printing, screen printing, flexographic printing, etc. The thermochromic material can be or can include diacetylene and/or or another thermochromic material capable of producing at least two colors, e.g., red and blue. In some embodiments, other additives that control and/or assist in heat absorption and/or heat retention may also be included in the layer 720. For example, in embodiments wherein the thermochromic material is heated by radiation, infrared (IR) and/or near infrared (NIR) radiation absorbers may be included in the layer to adjust the response of the thermochromic material to the radiation.

Prior to processing by heating and UV radiation exposure, the thermochromic material in layer 720 may be colorless. For example, prior to processing, the layer 220 can be substantially clear such that the substrate 710 is visible through the thermochromic material of layer 720. After processing, the thermochromic material in the non-activated pixels 723 can remain substantially clear such that the substrate 710 is visible through the pixels 723.

Each pixel 721, 722, 723 of the thermochromic layer 720 is individually addressable by imaging heat sources 730-1, 730-2, 730-3. The controller 750 maps pixels of the image to pixels 721, 722, 723 of the thermochromic material and individually selects certain pixels 721, 722 for color shifting according to the image being formed.

With reference to FIG. 7A, during the first heating step, the controller 750 controls the first heat source 730-1 to generate a first heat producing energy 790-1 that heats each individually selected pixel 721, 722 to one or more first temperatures. In some scenarios, each individually selected pixel 721, 722 may be heated to the same first temperature that is sufficient to activate the individually selected pixels 721, 722. Alternatively, a first set of the individually selected pixels 721, 722 may be heated to a higher first temperature, a second set of the individually selected pixels 721, 722 may be heated to a lower first temperature, etc., to achieve different levels of activation corresponding to lighter or darker saturation of the final pixel colors. Pixels 723 are not selected for activation and are not included in the group of individually selected pixels 721, 722 heated by the first heat source 730-1.

Figure 7B:
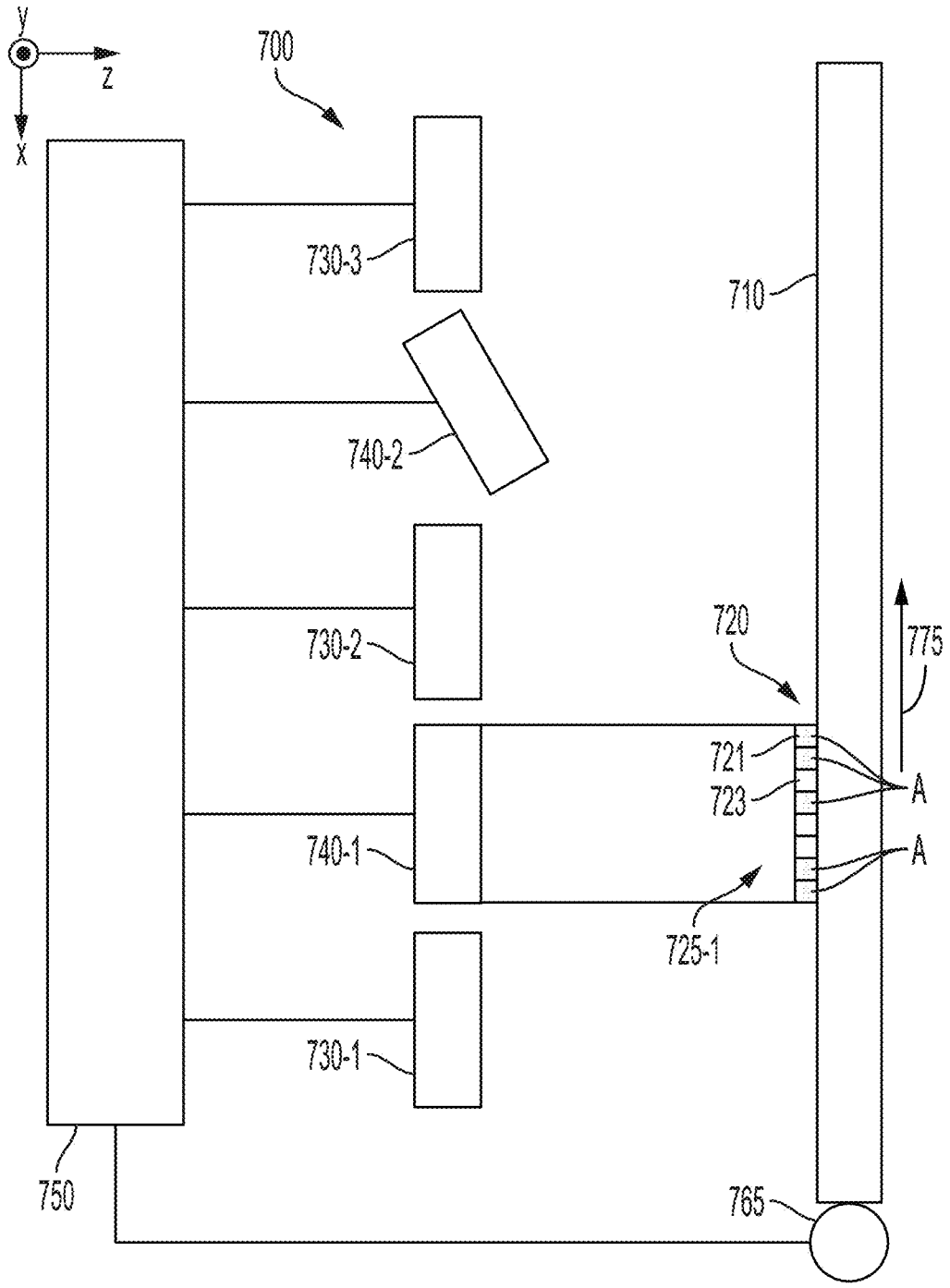

As shown in FIG. 7B, after the individually selected pixels 721, 722 have been activated, the substrate 710 is moved by movement mechanism component 765 along the processing direction of arrow 775 to bring the pixels 721, 722 of the thermochromic layer 720 into position to be flooded by the first UV radiation source 740-1. The first UV radiation source 740-1 generates the first UV radiation exposure 780-1 that floods the area 725-1 that includes the individually selected pixels 721, 722. The first radiation exposure 780-1 causes the individually selected pixels 721, 722 to undergo a color change. The pixels that have changed color are marked as "A" in FIG. 7B.

Figure 7C:
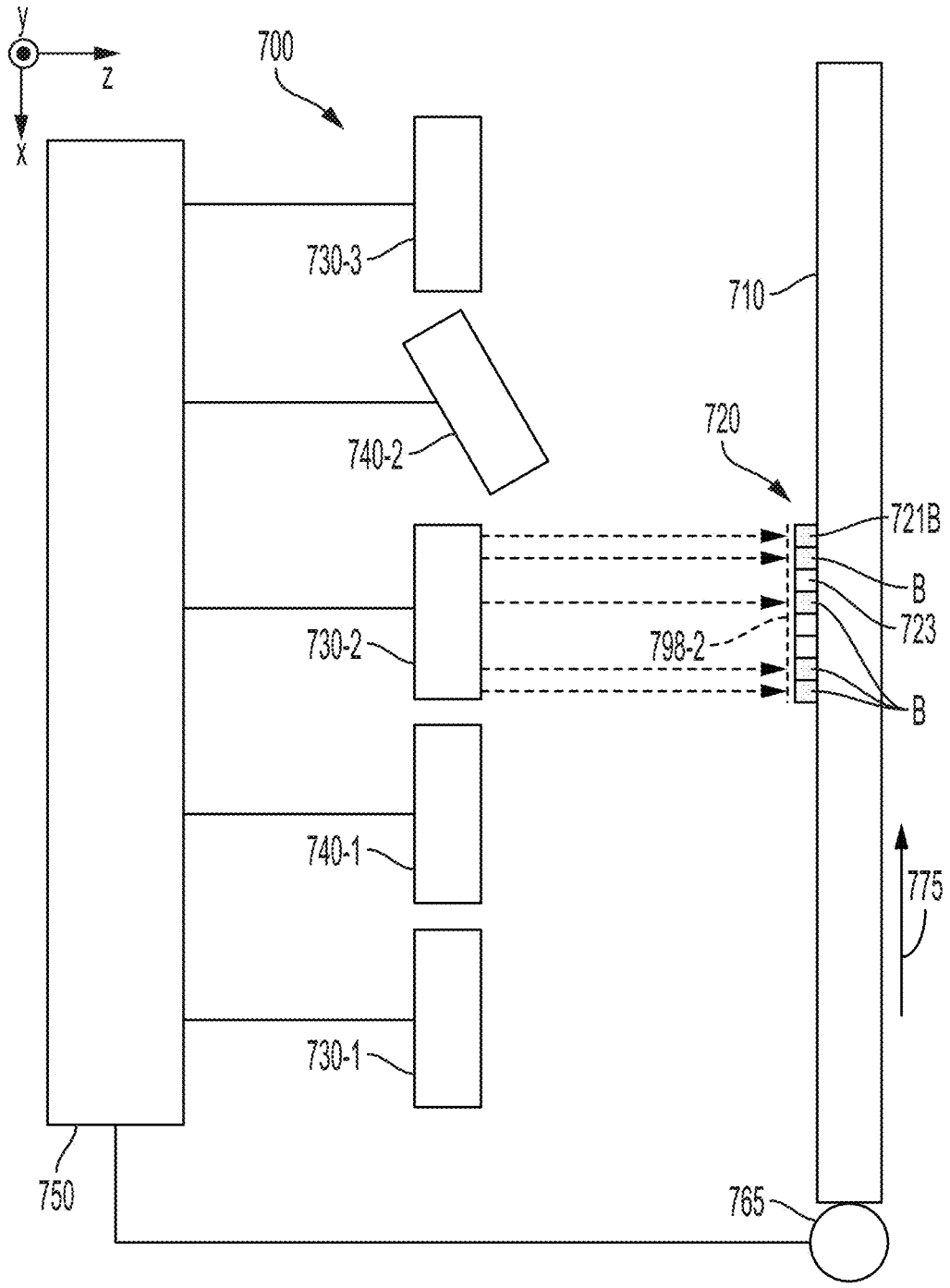

With reference to FIG. 7C, after the area 725-1 has been flooded with the first UV radiation exposure 780-1, the movement mechanism component 765 moves the substrate 710 along the direction of arrow 775 to bring the individually selected pixels of the thermochromic layer 720 into position to heated by the second heat source 730-2. The controller 750 controls the second heat source 730-2 to generate a second heat producing energy 790-2 that heats the individually selected pixels 721, 722 to one or more second temperatures. Heating to the second temperatures color shifts the pixels 721, 722 to one or more colors. The color shifted pixels are marked as "B" in FIG. 7C. It will be appreciated that depending on the intensity variation of the heat producing energy 790-2 in the two dimensional image plane 798-2, different individually selected pixels may undergo different levels of color shift and therefor may attain different colors during the second heating step shown in FIG. 7C.

After the individually selected pixels 721, 722 have been heated by the second heat source 730-2, the movement mechanism component 765 moves the substrate 710 along the direction of arrow 775. The movement of the substrate 710 brings the thermochromic layer 720 into position for performing one or multiple iterative cycles in which the individual pixels are flooded with UV radiation by the second UV source 740-2 followed by a heating step by a third heat source 730-3.

Figure 7D:
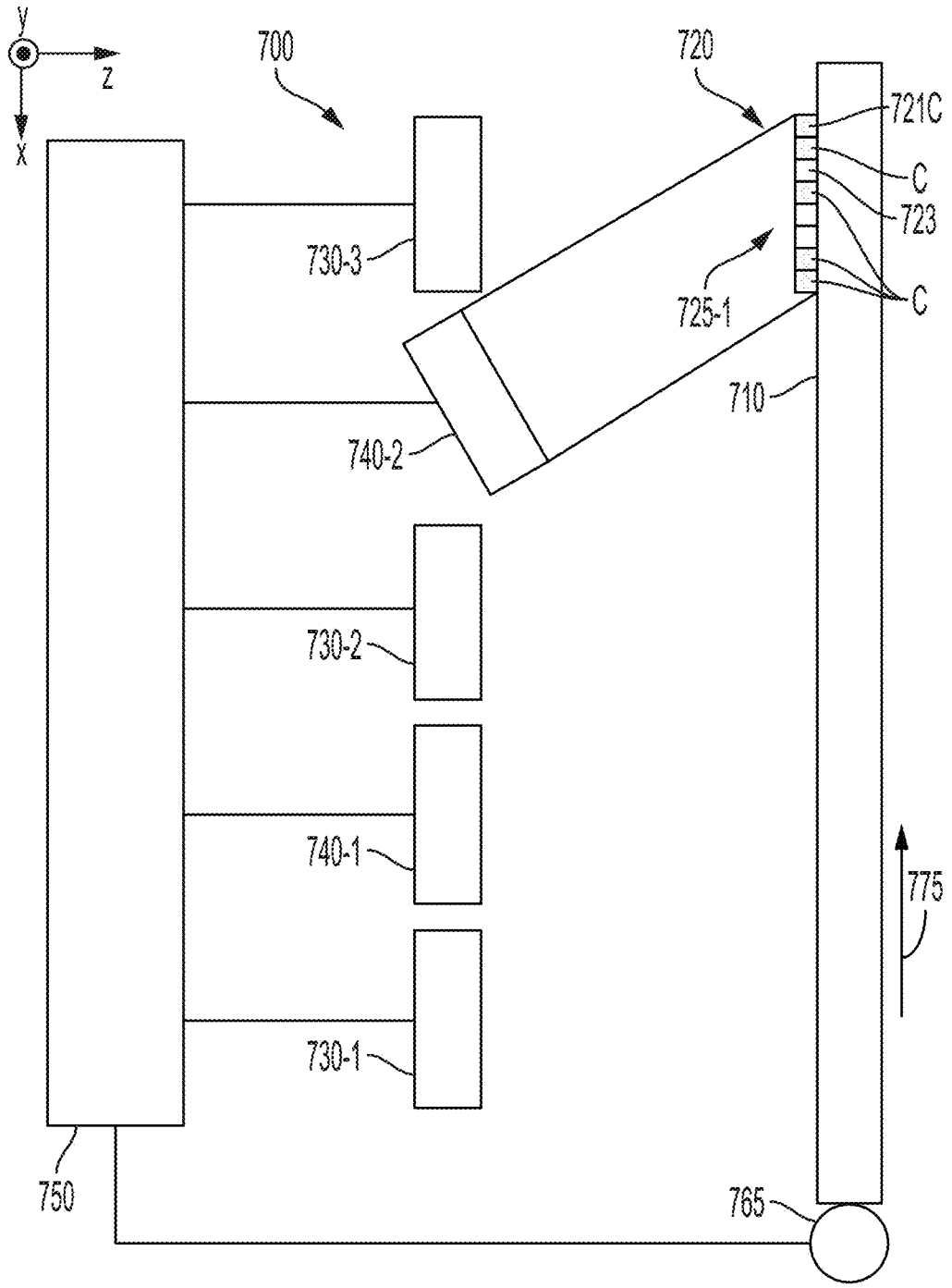
Figure 7E:
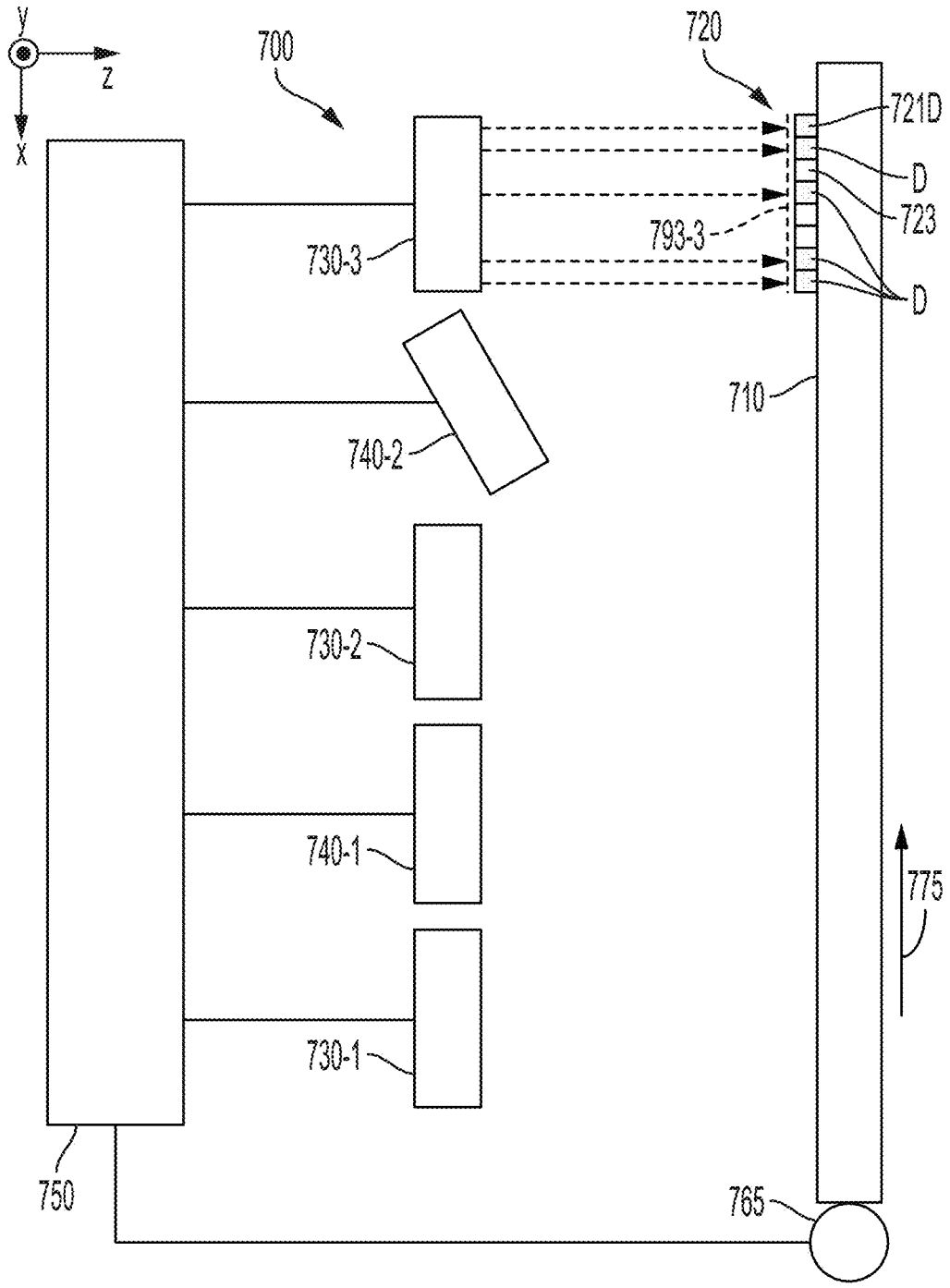

FIGS. 7D and 7E illustrate a first additional cycle comprising a UV radiation flood exposure step by the second UV radiation source 740-2 (FIG. 7D) followed by a heating step by third heat source 730-3 (FIG. 7E). During the UV radiation exposure step of the first additional cycle shown in FIG. 7D, the pixels 721, 722 are flood exposed to UV radiation. During the heating step of the first additional cycle shown in FIG. 7E, individually selected pixels 721, 722 are heated to one or more additional temperatures that correspond to one or more desired color shifts. The pixels that are color shifted during the first additional cycle are marked as "C" in FIG. 7D and "D" in FIG. 7E.

Figure 7F:
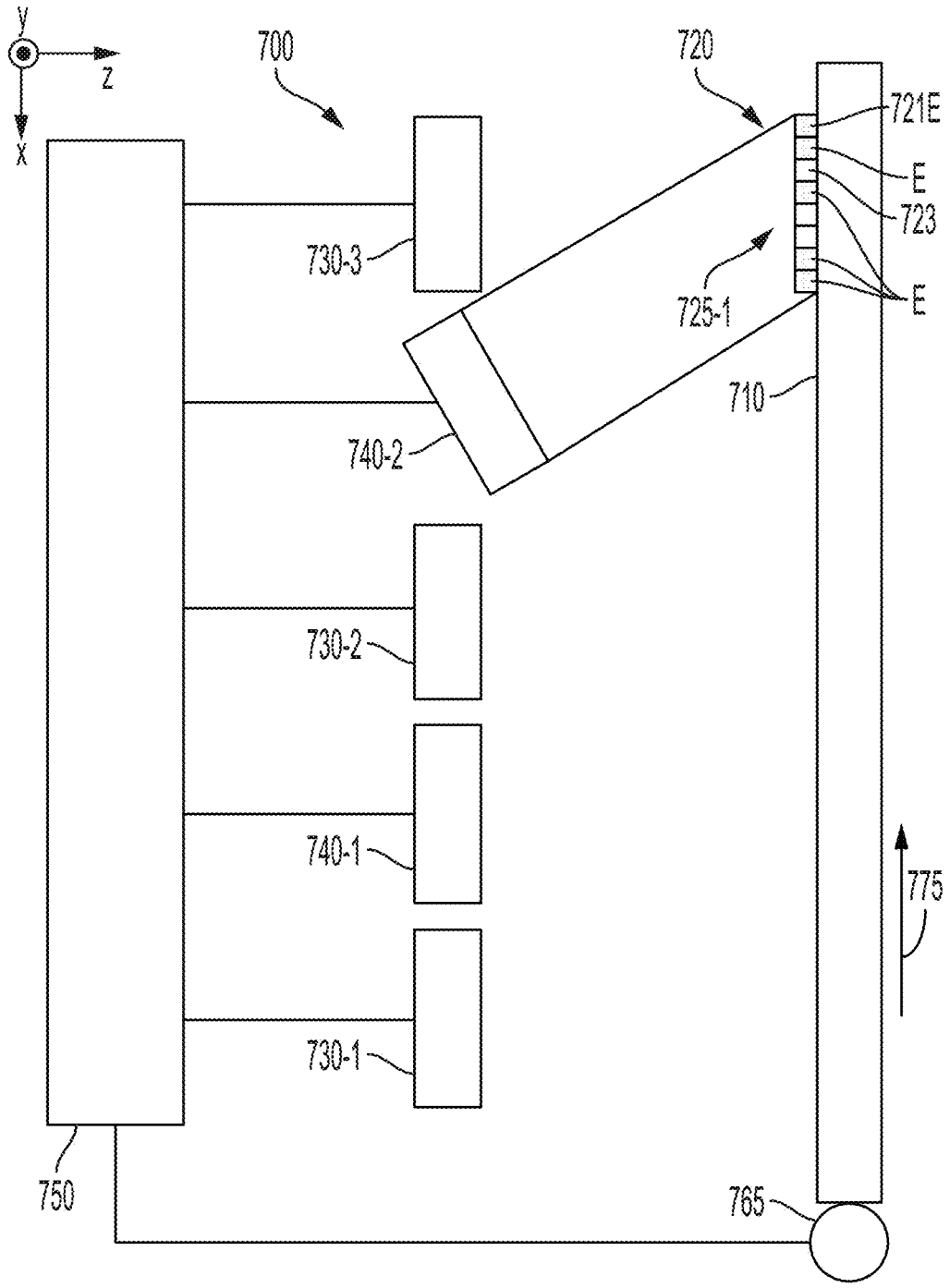
Figure 7G:
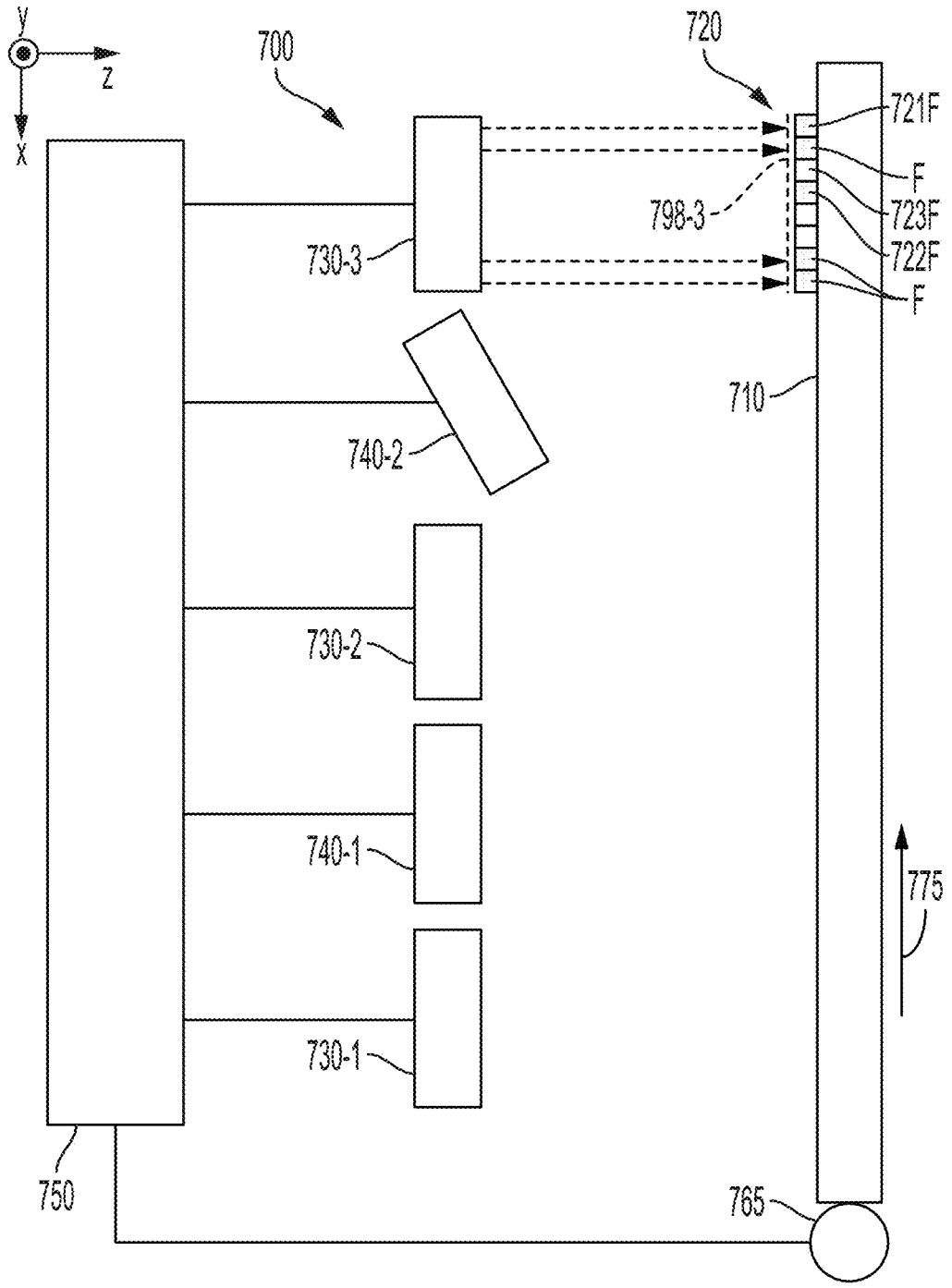

The system 700 may perform multiple additional cycles until desired color shifts of the pixels are obtained. In some scenarios different groups of individually selected pixels are heated during different cycles. FIGS. 7F and 7G illustrate a second additional cycle comprising a UV radiation flood exposure step by the second UV radiation source 740-2 (FIG. 7F) followed by a heating step by third heat source 730-3 (FIG. 7G). During the UV radiation exposure step of the second additional cycle, the pixels 721, 722 are flood exposed to UV radiation 780-2. During the heating step of the second additional cycle, individually selected pixels 721 are heated to one or more temperatures that correspond to one or more desired color shifts. During the second additional cycle, pixels 722 are flooded by UV radiation 780-2 but are not heated. Thus, assuming identical prior processing of pixels 721 and 722, pixels 722 would have attained a different color when compared to pixels 721 after the second additional cycle. The pixels that are color shifted during the second additional cycle are marked as "E" in FIG. 7F and "F" in FIG. 7G.

According to some embodiments, after the final additional cycle, the individually selected pixels may be concurrently exposed to heat and UV radiation which serves to stabilize the color of the pixels. Additional information about color stabilization achieved by concurrent UV radiation and heat processing can be found in commonly owned and concurrently filed U.S. patent application Ser. Nos. 16/211,749 and 16/211,810 filed Dec. 6, 2018 which are incorporated herein by reference.

Each heat source can be capable of heating each individually addressable pixel without substantially heating neighboring pixels. An ideal spatial intensity profile for the heat producing energy applied to a single pixel would be a top hat profile, however, in practice the spatial intensity profile for a signal pixel would be more Gaussian.

In some embodiments, the heat source can be configured to produce heating energy that is applied sequentially to each individually selected pixel of the thermochromic layer during the first, second, and/or additional heating steps. One or more of the heat sources may comprise a single heating element and the heat producing energy from the single heating element is scanned across the thermochromic layer to sequentially heat the individually selected pixels pixel-by-pixel. For example, the single heating element may comprise a resistive heating element, a jet configured to expel a stream of hot gas, or a laser source configured to emit laser radiation.

In some embodiments, the heat source can be configured to heat multiple individually selected pixels simultaneously during the first, second, or additional and/or heating steps. For example, simultaneous heating of multiple pixels can be achieved when the heat producing energy is spatially patterned in a two dimensional image plane.

Multiple individually selected pixels of the thermochromic layer can be simultaneously heated to one or more first temperatures during the first heating step, to one or more second temperatures during the second heating step, and to one or more additional temperatures during the heating steps of the additional cycles. Two or more of the first, second, and additional temperatures may have overlapping ranges. Two or more of the first, second, and additional temperatures may have non-overlapping ranges.

In some implementations the heat source may comprise multiple heating elements arranged in a two dimensional heating element array that generates a spatial pattern of heat producing energy in a two dimensional image plane. For example, the multiple heating elements may comprise a two dimensional array of resistive heating elements, a two dimensional array of jets configured to expel a stream of hot gas, or a two dimensional array of lasers. At any point in time, each heating element of the array can produce a different amount of heat producing energy so as to simultaneously heat individual pixels of the thermochromic material to different first and/or second temperatures according to the image being produced.

In some implementations the heat source may comprise a single heating element in combination with a spatial heat producing energy pattern generator. The single heating element in combination with the spatial heat producing energy pattern generator creates a spatial pattern of heat producing energy in a two dimensional image plane. The combination of the single heating element and the spatial heat producing energy pattern generator can simultaneously heat individual pixels of the thermochromic material to multiple different temperatures according to the colors of the image being produced.

Figure 8A:
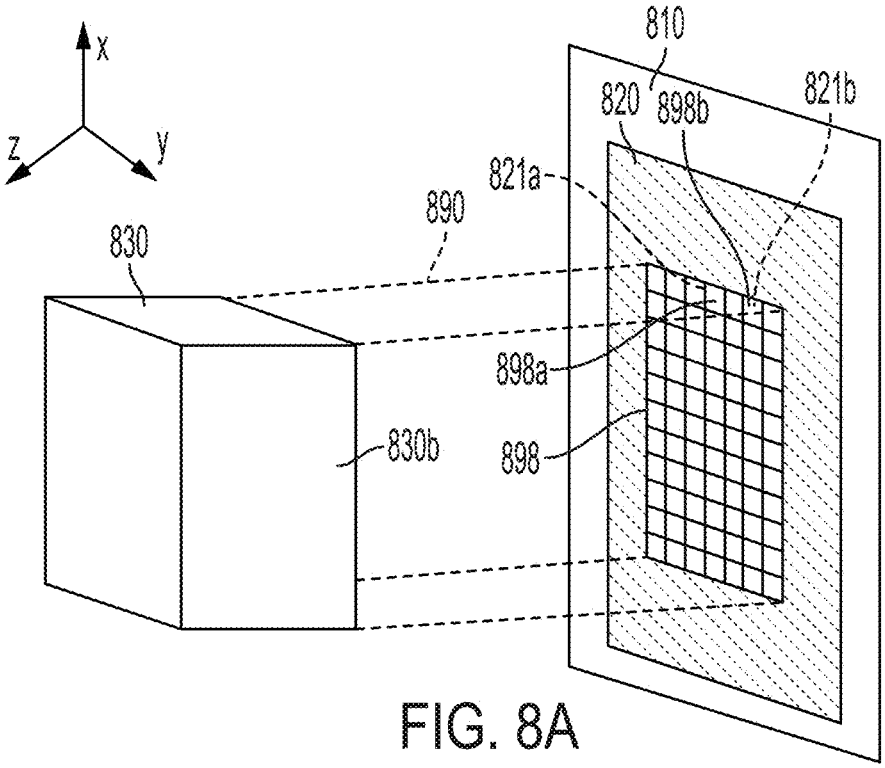
FIG. 8A shows a perspective view of a heat source and a two dimensional image plane of heat producing energy produced by the heat source.
Figure 8B:
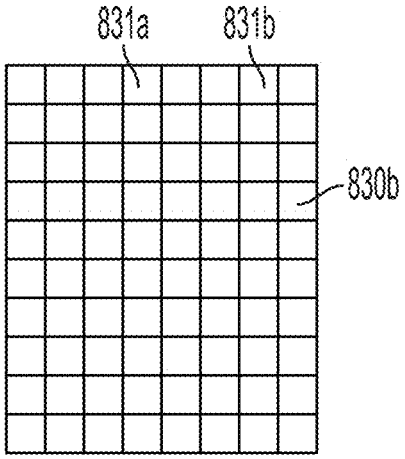
FIG. 8B shows a view of a two dimensional array of heating elements of a heat source

FIG. 8A shows a perspective view of a heat source 830 (which may represent any one or more of the first, second, and third heat sources shown in FIG. 7A) and a two dimensional image plane 898 of heat producing energy 890 produced by the heat source 830 and projected onto pixels 821*a*, 821*b* of thermochromic material 820 disposed on a substrate 810. FIG. 8B shows a view of an array 830*b* of heating elements 831*a*, 831*b* of the heat source 830 which can be used to produce the image plane 898 of heat producing energy 890. In some embodiments, the array of heating elements can be one pixel wide along the x direction and multiple pixels long along the y direction. In some embodiments, the array of heating elements can be multiple pixels wide along the x direction and multiple pixels long along the y direction. At any point in time, each heating element 831*a*, 832*b* may produce a different amount of heat producing energy (or no heat producing energy) to provide a spatial heating pattern of the two dimensional image plane 898 which can include spatially varying intensity of the heat producing energy 890.

Figure 8C:
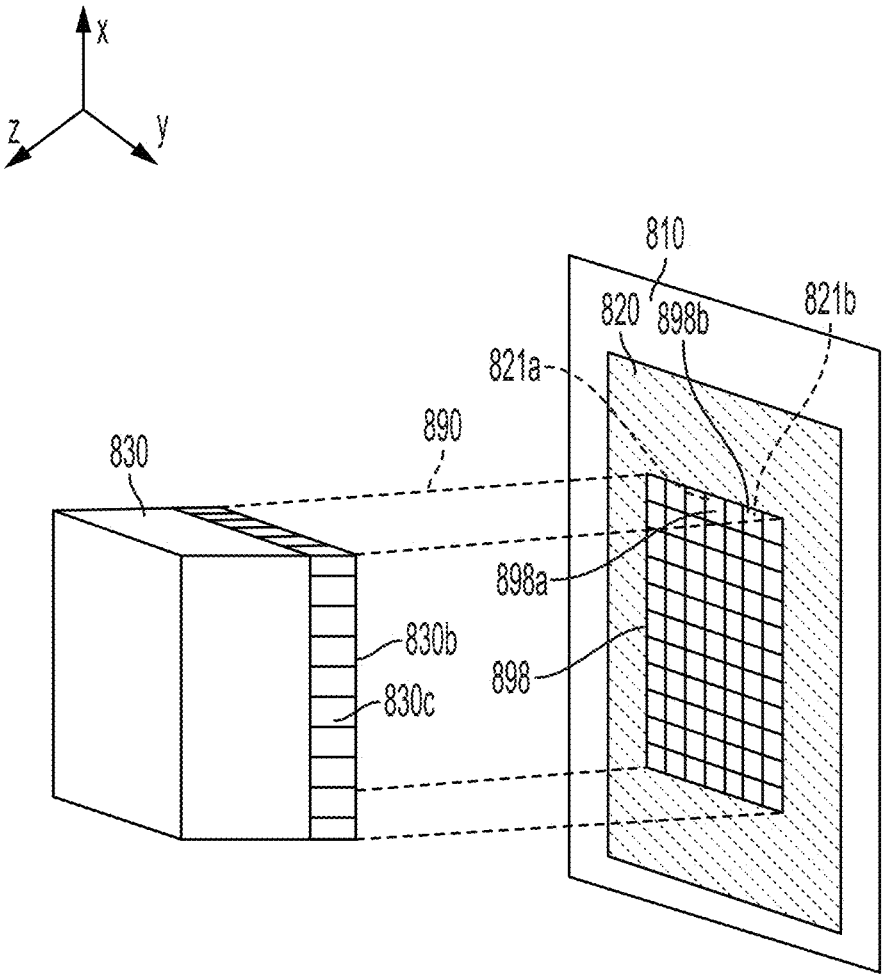
FIG. 8C shows a perspective view of a heat source that also includes intervening elements disposed between the heat source and the pixels.
Figure 8D:
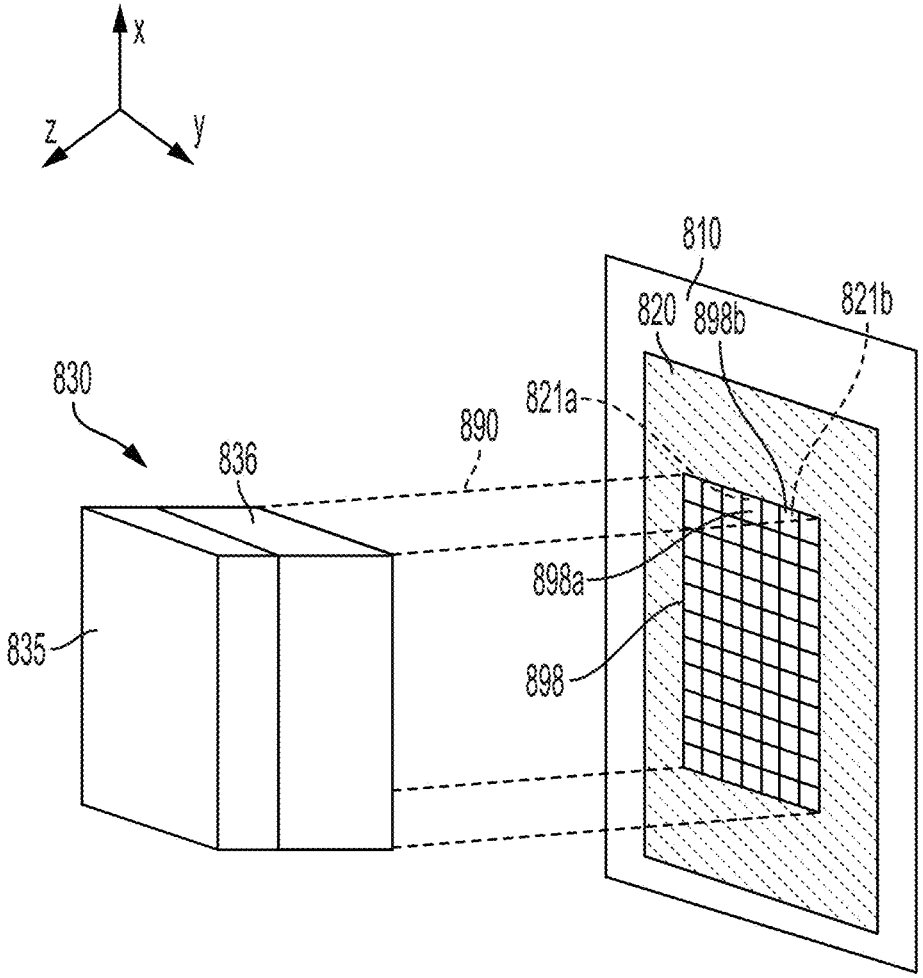
FIG. 8D shows a perspective view of a heat source and a single intervening element disposed between the heat source and the pixels.

FIG. 8C shows a perspective view of a heat source 830 that also includes multiple elements 830*c* disposed between the heat source 830 and the pixels 821*a*, 821*b*. FIG. 8D shows a perspective view of a heat source 830 that also includes an element 836 disposed between the heat source 830 and the pixels 821*a*, 821*b*.

The heat producing energy 890 may flow directly from the heating elements 831*a*, 831*b* to the pixels 821*a*, 821*b* in some implementations as indicated in FIG. 8A. In some implementations, illustrated in FIGS. 8C and 8D, one or more intervening elements 830*c*, 836 disposed between the heating elements 831*a*, 831*b* and the pixels 821*a*, 821*b* may spatially pattern the heat producing energy 890. The elements 830*c*, 836 may comprise energy modulators, energy spatial pattern generators, energy guiding elements such as energy reflectors and energy deflectors, etc. The elements 830*b*, 836 may modulate, pattern, guide, reflect and/or deflect the heat producing energy 890 to produce the image plane 898 as further discussed in the examples below.

In some embodiments, the heat source 830 may comprise one or more resistive heating elements. Current flowing through the resistive heating elements generates the heat producing energy 890 for heating pixels 821*a*, 821*b* of the thermochromic material 820 to produce an image. For example, a resistive heat source 830 may comprise a two dimensional array 830*b* of resistive heating elements 831*a*, 831*b* capable of forming a two dimensional image plane 898 of spatially patterned heat energy 890. In some embodiments, the heat source 830 may comprise a two dimensional array 830*b* of resistive heating elements 831*a*, 831*b* such that each resistive heating element 831*a*, 831*b* respectively corresponds to a pixel 821*a*, 821*b* of the thermochromic layer 820.

During the heating steps discussed in connection with FIGS. 7A through 7G, the spatially patterned heat energy 890 may provide the individually selected pixels within the image plane 898 with the same amount or heat energy or different amounts of heat energy, so that some of the individually selected pixels 821*a* are heated higher temperatures and others of the selected pixels 821*b* are heated lower temperatures To facilitate heating different pixels to different temperatures, each resistive element 831*a*, 831*b* may be individually controllable. For example, the controller 750 may independently control the current through each of the multiple heating resistive elements 831*a*, 831*b* allowing resistive heating elements 831*a*, 831*b* to provide the same amount of heat to each of the pixels 821*a*, 821*b* or to provide different amounts of heat to different pixels 821*a*, 821*b*.

In some embodiments, the heat source 830 may comprise a source of a heated gas, such as heated air, and one or more gas jets that direct the heated gas toward the pixels of thermochromic material. The heat source 830 may comprise an array 830*b* of multiple gas jets 831*a*, 831*b*. The one or more gas jets can direct the same amount of heated gas toward each of the individually selected pixels 821*a*, 821*b* of the thermochromic layer 820. Alternatively, the one or more gas jets may be capable of directing different amounts of heated gas toward different pixels 821*a*, 821*b* of the thermochromic layer 820. In some embodiments, the heat source 830 may comprise a two dimensional array 830*b* of gas jets 831*a*, 831*b* such that each gas jet 831*a*, 831*b* respectively corresponds to a pixel 821*a*, 821*b* of the thermochromic layer 820.

In some embodiments, the heating elements 831*a*, 831*b* of the heat source 830 may comprise one or more lasers that direct heat producing energy 890 (laser radiation) toward the thermochromic material 820. For example, in some embodiments, the laser radiation may be visible, infrared (IR) or near infrared (NIR) radiation that heats the thermochromic material, although other radiation wavelengths may also be useful for heating the thermochromic material.

In some embodiments, the heat source 830 may comprise an array 830*b* of lasers 831*a*, 831*b* such that each laser 831*a*, 831*b* respectively corresponds to a pixel 821*a*, 821*b* of the thermochromic layer 820. The array 830*b* of lasers 831*a*, 831*b* is capable of generating an image plane 898 of spatially patterned laser radiation 890.

In some embodiments, multiple guiding elements 830*c*, e.g., waveguides or optical fibers, may be disposed between each laser 831*a*, 831*b* and a corresponding pixel 821*a*, 821*b* of the thermochromic material 820. For example, the each laser 831*a*, 831*b* may be optically coupled to an input end of a corresponding optical fiber 830*c*. The optical fiber 830*c* directs the laser radiation from the laser which emerges from the output end of the optical fiber 830*c* toward the thermochromic material 820. In this embodiment, the lasers 831*a*, 831*b* themselves need not be arranged in an array corresponding to the pixels of the image because the output ends of the optical fibers 830*c* can be arranged in an array providing a spatial radiation pattern that forms a image plane 898 of spatially patterned radiation to heat the pixels. The controller 750 may comprise circuitry that individually modulates the intensity of each laser 831*a*, 831*b* so as to provide a different intensity of laser radiation to different pixels 821*a*, 821*b*.

As illustrated in FIG. 8D according to some embodiments, the heat source 830 comprises a single heat element 835, such as a single laser, that is coupled to an element 836 that spatially patterns the heat producing energy from the single heat element 835. For example, the heat source 830 may comprise a single laser and the element 836 may comprise a device pattern generator that spatially patterns the radiation generated by the single laser to produce an image plane 898 of heat producing radiation 890. The spatially patterned radiation may vary in radiation intensity across the image plane 898. For example, the spatial radiation patterning device 836 may comprise one or more of a liquid crystal spatial radiation modulator such as a liquid crystal on silicon (LCOS), a digital micromirror device (DMD), a grating light valve (GLV), and an acousto-optic modulator (AOM). In some embodiments, such as when the spatial pattern generator is a GLV, the two dimensional image plane may be only one pixel wide in the process direction (direction along arrow 175 in FIG. 1) and the entire width of the substrate in the cross process direction (direction perpendicular to arrow 175 in FIG. 1). In other embodiments, such as when the spatial pattern generator is a DMD, the two dimensional image plane may be multiple pixels wide, e.g., 10 pixels wide, in the process direction and the entire width of the paper in the cross process direction.

Various modifications and alterations of the embodiments discussed above will be apparent to those skilled in the art, and it should be understood that this disclosure is not limited to the illustrative embodiments set forth herein. The reader should assume that features of one disclosed embodiment can also be applied to all other disclosed embodiments unless otherwise indicated. It should also be understood that all U.S. patents, patent applications, patent application publications, and other patent and non-patent documents referred to herein are incorporated by reference, to the extent they do not contradict the foregoing disclosure.

The invention claimed is:

1. An article, comprising:

a substrate; and a layer of thermochromic material disposed in or on the substrate, a color of one or more regions of the thermochromic material falling within a region of a standard CIE color chart above about 0.25 and below about 0.4 on the y-axis and above 0.2 and below about 0.5 on the x-axis.

2. The article of claim 1, wherein the thermochromic material comprises a material capable of producing at least two colors.

3. The article of claim 1, wherein the thermochromic material comprises a material capable of producing at least red and blue.

4. The article of claim 1, wherein the thermochromic material comprises diacetylene.

5. The article of claim 1, wherein the thermochromic material comprises one or more additives configured to one or both of control and assist in one or both of heat absorption and heat retention.

6. The article of claim 1, wherein the thermochromic material comprises one or both of infrared (IR) radiation absorbers and near infrared (NIR) radiation absorbers configured to adjust a response of the thermochromic material to the radiation.

7. The article of claim 1, wherein the layer of thermochromic material comprises:

one or more first regions that are substantially clear such that the substrate is visible through the thermochromic material at the one or more first regions; and one or more second regions that include the color.

8. An article, comprising:

a substrate; and a layer of thermochromic material disposed in or on the substrate, a color of one or more regions of the thermochromic material falling within a region of a standard CIE color chart bounded by a line expressed by the equation $y>0.47x+0.08$ and a line expressed by the equation $y<0.47x+0.2$.

9. The article of claim 8, wherein the thermochromic material comprises a material capable of producing at least two colors.

10. The article of claim 8, wherein the thermochromic material comprises a material capable of producing at least red and blue.

11. The article of claim 8, wherein the thermochromic material comprises diacetylene.

12. The article of claim 8, wherein the thermochromic material comprises one or more additives configured to one or both of control and assist in one or both of heat absorption and heat retention.

13. The article of claim 8, wherein the thermochromic material comprises one or both of infrared (IR) radiation absorbers and near infrared (NIR) radiation absorbers configured to adjust a response of the thermochromic material to the radiation.

14. The article of claim 8, wherein the layer of thermochromic material comprises:

one or more first regions that are substantially clear such that the substrate is visible through the thermochromic material at the one or more first regions; and one or more second regions that include the color.

15. An article, comprising:

a substrate; and a layer of thermochromic material disposed in or on the substrate, a color of one or more regions of the thermochromic material falling within:

a region of a standard CIE color chart above about 0.25 and below about 0.4 on the y-axis and above 0.2 and below about 0.5 on the x-axis; and a region of a standard CIE color chart bounded by a line expressed by the equation $y>0.47x+0.08$ and a line expressed by the equation $y<0.47x+0.2$.

16. The article of claim 15, wherein the thermochromic material comprises a material capable of producing at least two colors.

17. The article of claim 15, wherein the thermochromic material comprises a material capable of producing at least red and blue.

18. The article of claim 15, wherein the thermochromic material comprises diacetylene.

19. The article of claim 15, wherein the thermochromic material comprises one or more additives configured to one or both of control and assist in one or both of heat absorption and heat retention.

20. The article of claim 15, wherein the thermochromic material comprises one or both of infrared (IR) radiation absorbers and near infrared (NIR) radiation absorbers configured to adjust a response of the thermochromic material to the radiation.

21. The article of claim 15, wherein the layer of thermochromic material comprises:

one or more first regions that are substantially clear such that the substrate is visible through the thermochromic material at the one or more first regions; and one or more second regions that include the color.

* * * * *